United States Patent [19]

Kanetake

[11] 4,164,435

[45] Aug. 14, 1979

[54] METHOD FOR HEAT TREATMENT OF LINK CHAINS

[75] Inventor: Norio Kanetake, Tokyo, Japan

[73] Assignee: Kabushiki Kaisha Kito, Kawasaki, Japan

[21] Appl. No.: 801,976

[22] Filed: May 31, 1977

[30] Foreign Application Priority Data

Jun. 16, 1976 [JP] Japan ..... 51-69666

[51] Int. Cl.[2] ..... C21D 9/00

[52] U.S. Cl. ..... 148/153; 148/146; 148/150

[58] Field of Search ..... 148/146, 150, 153, 143

[56] References Cited

U.S. PATENT DOCUMENTS 3,790,413 2/1974 Kanetake ..... 148/146

*Primary Examiner*—R. Dean

*Attorney, Agent, or Firm*—Sughrue, Rothwell, Mion, Zinn and Macpeak

[57] ABSTRACT

A method and an apparatus for heat treatment of link chains wherein the link chain is continuously introduced into a high frequency induction furnace for quenching to heat it in a manner such that the austenitizing temperature at curved portions of a link element of the link chain is higher than that at parallel portions of the like element and such that the temperatures change smoothly and continuously between the curved and parallel portions thereby to avoid sudden temperature transitions and thereafter the chain link is rapidly cooled in succession for quenching, and the quenched link chain is also continuously introduced into a high frequency induction furnace for tempering to heat it in a manner that the temperature at the parallel portions is higher than that of the curved portions of the link element and thereafter the chain link is cooled in succession for tempering.

10 Claims, 11 Drawing Figures

METHOD FOR HEAT TREATMENT OF LINK CHAINS

This invention relates to a method and an apparatus for heat treatment of iron or steel link chains for the purpose of producing high strength and wear resistant link chains, and more particularly to a method and an apparatus for continuously quenching and tempering link chains by heating the moving chains in a high frequency induction furnace to desired temperatures and thereafter cooling them by injected cooling liquid.

Link chains are widely used for hand-operated hoists, electric chain hoists, chain conveyors, chain slings and the like. It is most important to improve the strength of the link chains for safety. Moreover, higher strength link chains make it possible to use smaller link elements for the same load capacities and therefore render the link chains themselves and hence the above machines such as chain hoists and chain conveyors smaller and light weight which will be handled easier. Accordingly, higher strength link chains are very advantageous for these machines.

However, there has been a tendency for link chains to be insufficiently heat treated at portions adapted to be in contact with adjacent link elements and in contact with chain wheels because these portions are apt to be insufficiently heated when being subjected to the heat treatment. Accordingly, when link chains for the machines are used frequently or used for many years, considerable wear often occurs at the insufficient heat treated portions of the link chains, resulting often into destruction of the chains to cause a great accident.

In order to solve these problems, the method according to the invention comprises steps of continuously heating each link element of the link chain such that austenitizing temperature at curved portions of said link element is higher than that at parallel portions of said link element, and cooling the thus heated link cahin to quench it.

In further aspect, the method according to the invention further comprises steps of heating said quenched link chain such that said parallel portions are heated at a temperature higher than that of the curved portions of said each link element, and cooling the thus heated link chain to temper it.

In another aspect, the apparatus for heat treating link chains comprises a quenching device and a tempering device, each device comprising a high frequency induction furnace and a cooling device arranged at an outlet of said furnace, and each said device comprising a thermometer provided at said outlet of said furnace for detecting temperatures at curved and parallel portions of each link element of said link chain to control said temperatures thereof.

An object of the invention is to provide an improved method and an apparatus for continuous heat treatment of link chains for producing link chains having high wear resistance at curved portions of link elements.

Another object of the invention is to provide a method and an apparatus for continuous heat treatment of link chains for producing link chains having high wear resistance at curved portions and improved toughness at parallel portions of link elements and having no metallurgical defects at welded portions thereby increasing the tensile strength and ultimate elongation to improve its shock resistance.

A further object of the invention is to provide an improved apparatus for a continuous heat treatment of link chains capable of automatically and precisely heating curved and parallel portions of link elements of the link chains to desired temperatures.

The invention will be more fully understood by referring to the following detailed specification and chains taken in connection with the appended drawings.

Figure 1:
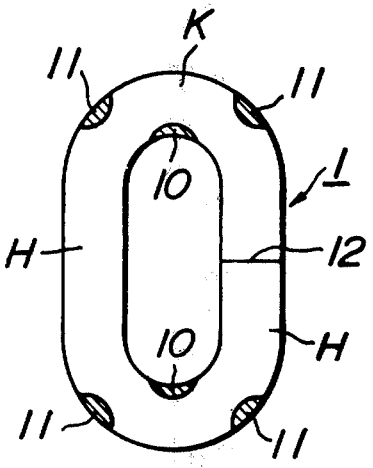
FIG. 1 is an elevation of a link element of a link chain showing contact portions adapted to be in contact with adjacent link elements and with chain wheels.

Referring to FIG. 1, when link chains for the above mentioned machines are used frequently or used for many years, considerable abrasion or wear often occurs on each link element of the link chains at contact portions 10 adapted to be in contact with adjacent link elements and at contact portions 11 adapted to be in contact with chain wheels, resulting often into breaking down of the link chain to cause a great accident.

Figure 2:
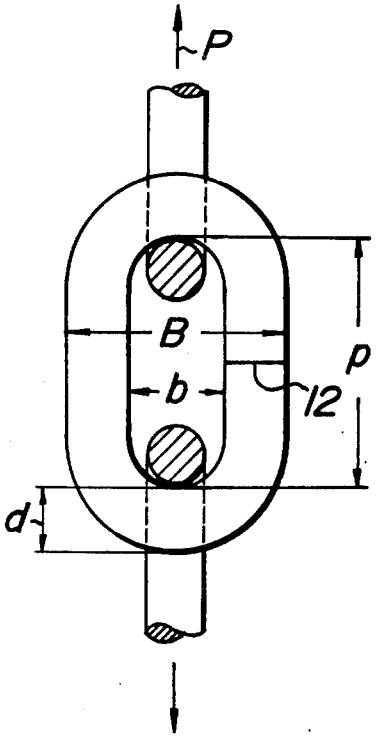
FIG. 2 is an elevation of a link element showing a tensile force acting thereupon and letters indicating dimensions of the link.
Figure 3:
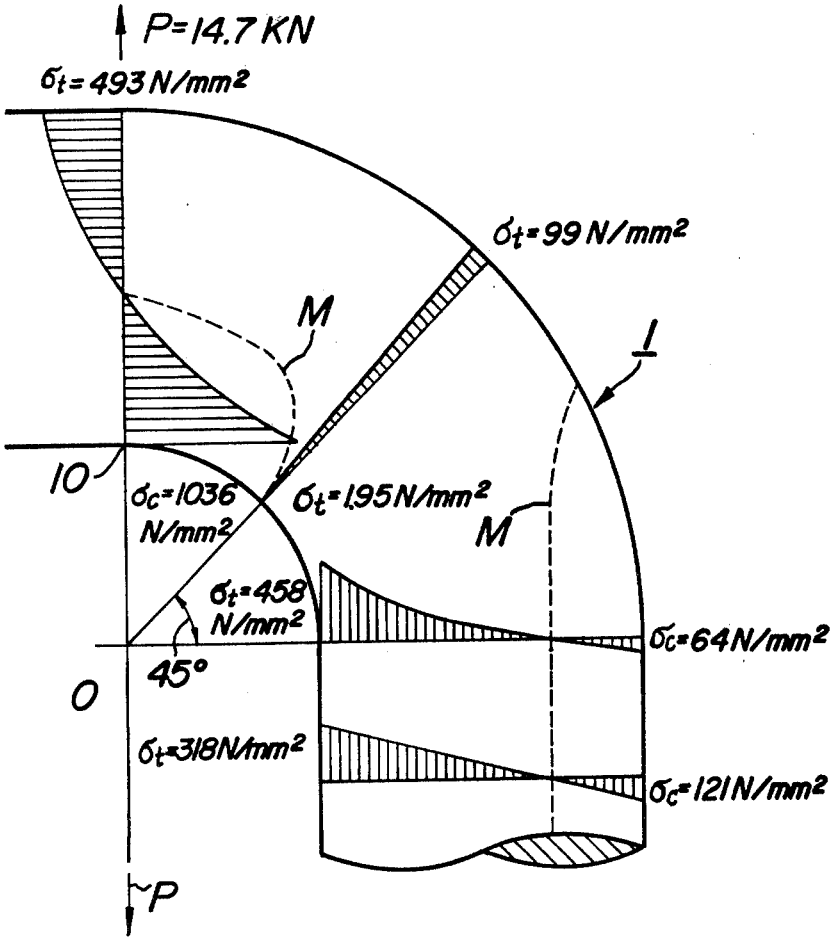
FIG. 3 is a stress distribution diagram of the link element subjected to the tensile force as shown in FIG. 2.

On the other hand, when a link chain is subjected to a load, a tensile force P acts upon a link element 1 as shown in FIG. 2. As an example, when a tensile force $P=14.7$ KN (Kilo Newton) acts upon a link element having a diameter of $d=9.5$ mm and a pitch of $p=28.6$ mm, a stress distribution in a fourth of the link element is as shown in FIG. 3 obtained from the stress calculation formulas of a curved beam. In the diagram in FIG. 3, a center of curvature is indicated by 0, neutral line M and tensile and compressive stresses $\sigma_t$ and $\sigma_c$.

As can be seen from FIG. 3, the maximum stress $\sigma_c$ occurs at the contact portion 10 where adjacent link elements are in contact with each other. It is therefore required to increase the strength at the portion 10 of the link element.

In case of a link element having a welded portion 12 (FIG. 2) in one of parallel (straight) portions H, defective welding or metallurgical defect or extraordinary microstructure at the welded portion such as the grain growth due to the heating for welding causes the welded portion to be separated to decrease the strength of the link chain itself.

To quench a link chain, heretofore, after the link chain is continuously passed through a furnace core tube of a high frequency induction furnace for uniform heating, it is rapidly cooled or quenched. As the curved portions of the adjacent link elements are engaged with each other in a fitted manner, the heat treatment at the contact portions tends to be insufficient to bring an incomplete quenched structure at the portions which will decrease the strength and hardness at the portions. The present invention overcomes the above disadvantages in the prior art.

FIGS. 4–8 indicate a preferred embodiment of the apparatus for heat treatment of link chains according to the invention and the heat treatment processes by the apparatus. The apparatus consists of quenching device 2, a tempering device 3, and an accumulating device therebetween, comprising an adjusting and accumulating chain pulley 13 which is driven at a suitable speed by a driving device provided with a variable speed gear for storing or reserving desired length of the link chain between the quenching and tempering devices 2 and 3.

Figure 4:
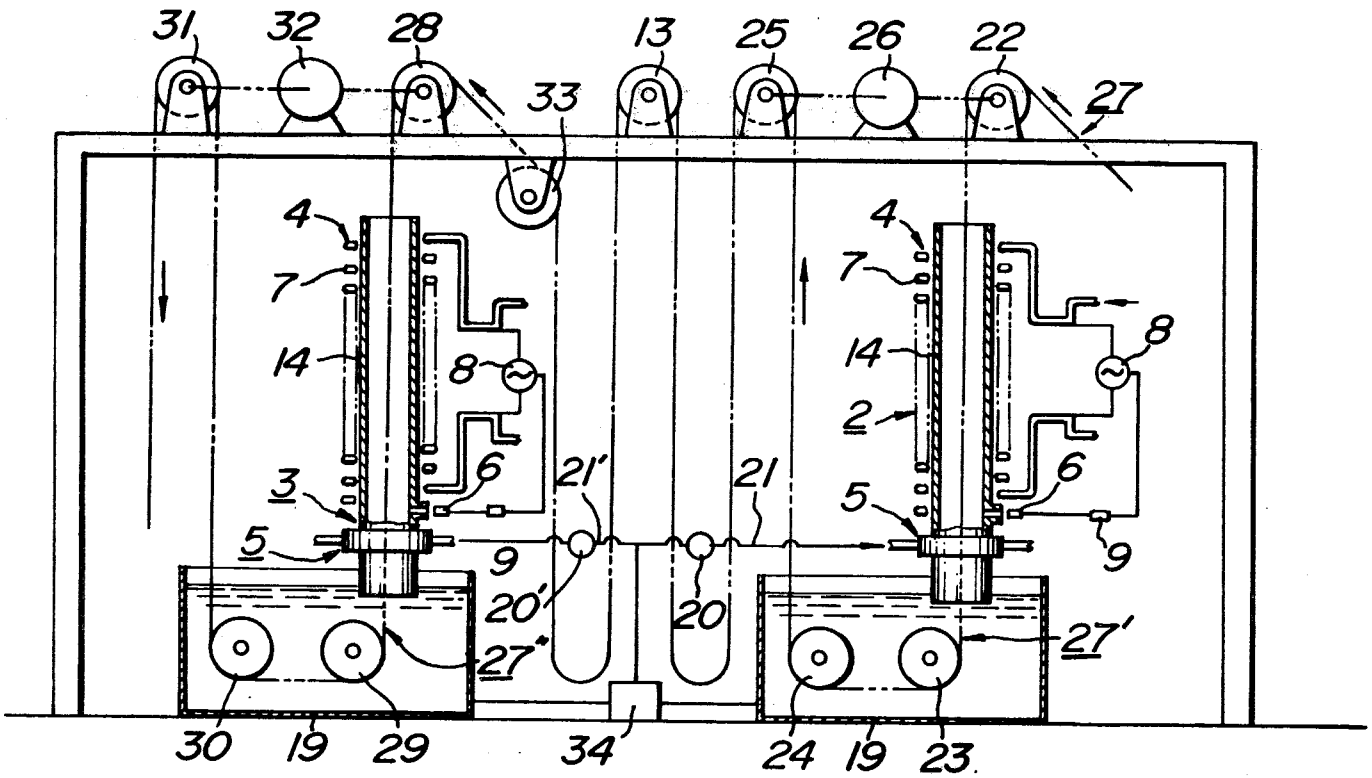
FIG. 4 is a sectional view of a preferred embodiment of the apparatus according to the invention showing the arrangement of respective parts.
Figure 5:
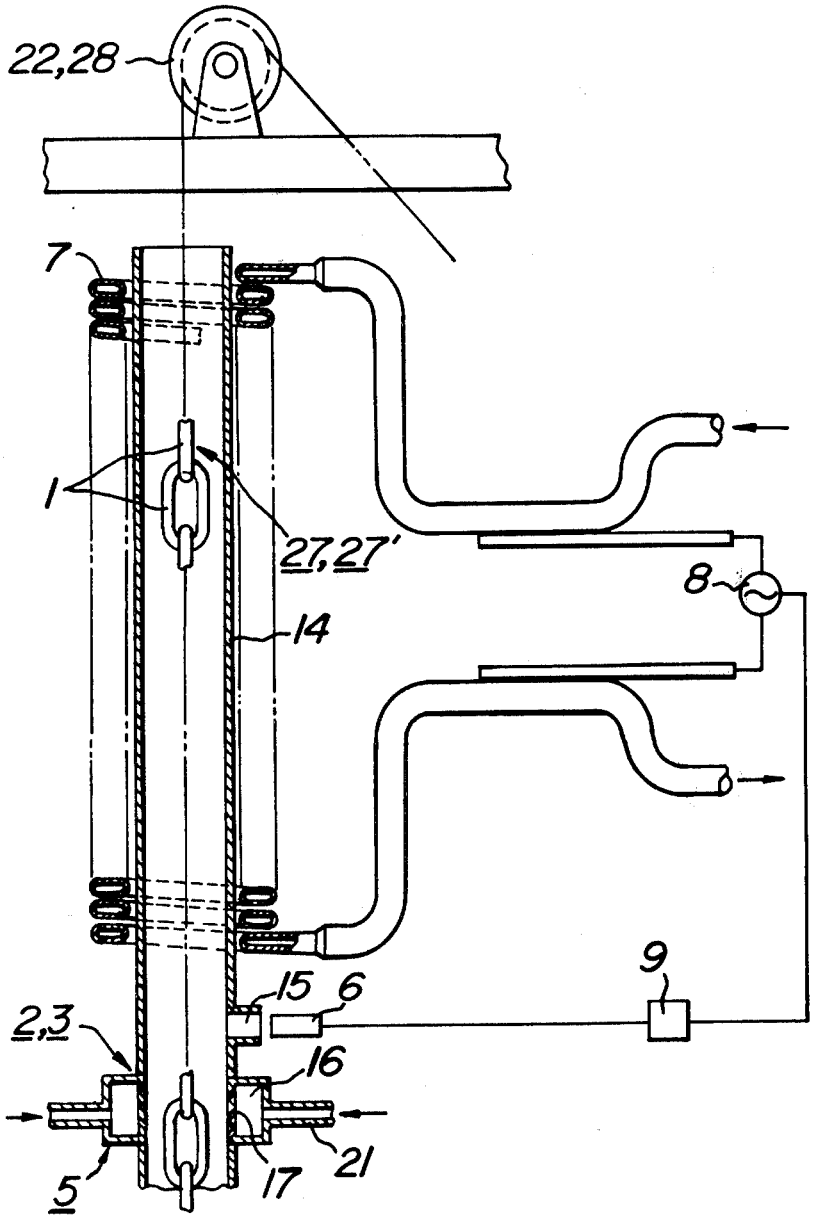
FIG. 5 is an enlarged sectional view of the heat treating section of the apparatus shown in FIG. 4.

Each of the quenching and tempering devices 2 and 3 consists of a vertical high frequency induction furnace 4 and a cooling device 5 arranged at the outlet or the bottom of the furnace 4 for injecting cooling liquid for quenching or tempering (FIG. 4). The high frequency induction furnace 4 consists of a vertical furnace core tube 14 of non-magnetic material as ceramic material or quartz and a high frequency induction heating coil 7 of a copper tube connected to a high frequency oscillator 8 (FIGS. 4 and 5). The furnace core tube 14 is concentrically arranged in the high frequency induction heating oil 7 whose copper tube is supplied with cooling liquid such as water and the like for circulation therein.

The furnace core tube 14 is provided at the side surface of its outlet of lower end with a window 15 for measuring the temperature of heated chains (FIGS. 4, 5, 6 and 7), in opposition to which is provided and infrared radiation thermometer 6. The thermometer 6 comprises a curved portion temperature measuring part for determining the temperature at the curved (semicircular) portions K of the link element 1 and a parallel portion temperature measuring part for determining the temperature at the parallel (straight) portions H. The high frequency oscillator 8 connected to the high frequency induction heating coil 7 is connected to the thermometer 6 through a temperature controller 9 for automatically controlling the high frequency oscillator 8 in order to heat the curved and parallel portions of the link elements to respective determined temperatures.

Figure 6:
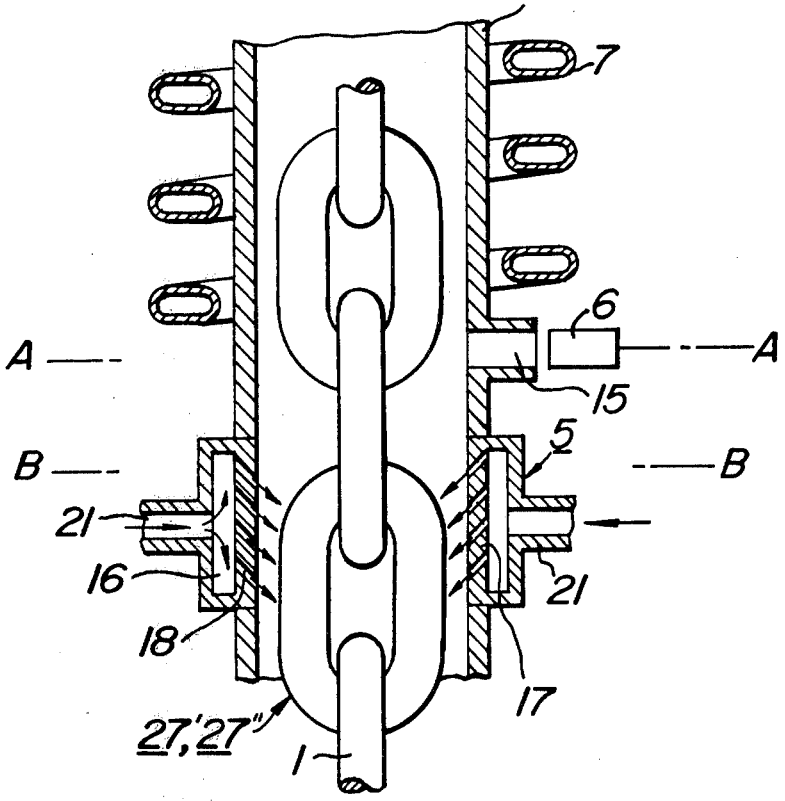
FIG. 6 is an enlarged sectional view of the temperature measuring and cooling sections of the apparatus shown in FIG. 4.
Figure 7:
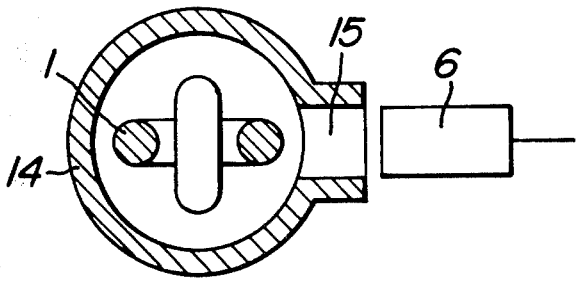
FIG. 7 is a cross-sectional view of the section taken along line A—A in FIG. 6.
Figure 8:
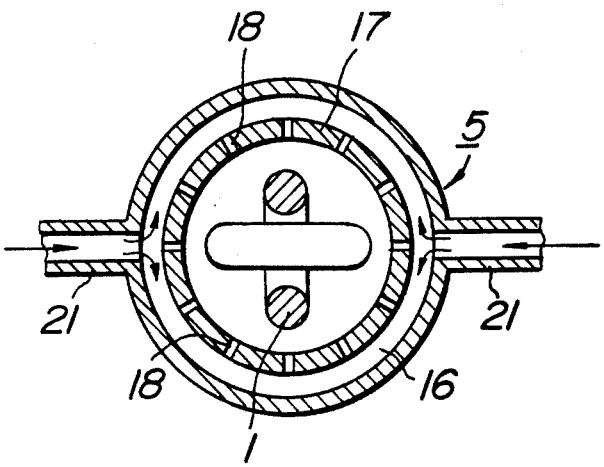
FIG. 8 is a cross-sectional view of the section taken along line B—B in FIG. 6.

The cooling device 5 for injecting cooling liquid comprises a liquid supply chamber 16 in the form of a hollow annulus having a rectangular or rounded cornered rectangular cross-section, of which inner wall 17 is formed with oblique liquid injection holes 18 extending downwardly and toward the center of the liquid supply chamber 16 (FIG. 6). The liquid supply chambers 16 for the vertical furnace core tubes 14 of quenching and tempering devices 2 and 3, and reservoir tanks 19 below the respective liquid supply chambers 16 are connected through a cooler 34, pumps 20 and 20' and liquid conduits 21 and 21' (FIG. 4). The cooling liquid as water or oil in the tanks 19 is cooled through a cooler 34 and then fed under pressure through the liquid conduits 21 and 21' into the liquid supply chambers 16 by means of the pumps 20 and 20' to be injected through the liquid injection holes 18 obliquely downwardly against the chain elements.

There are provided with a supply chain pulley 22 above the furnace core tube 14 of the quenching device 2, a centering chain pulley 23 and a turning chain pulley 24 in the reservoir tank 19 below the quenching device 2, and a feeding chain pulley 25 above the turning pulley 24. The feeding chain pulley 25 and the supply chain pulley 22 are driven at the same circumferential speed by means of a common driving device 26 for quenching. The link chain 27 fed by the supply chain pulley 22 passes through the centers of the furnace core tube 4 and the cooling device 5 and then delivered through the centering and turning chain pulleys 23 and 24 from the reservoir tank 19 by means of the feeding chain pulley 25.

There are also provided with a supply chain pulley 28 above the furnace core tube 14 of the tempering device 3, a centering chain pulley 29 and a turning chain pulley 30 in the reservoir tank 19 below the tempering device 3, and a feeding chain pulley 31 above the turning chain pulley 30. The feeding chain pulley 31 and the supply chain pulley 28 are driven at the same circumferential speed by means of a common driving device 32 for tempering. The link chain fed by the supply chain pulley 28 passes through the centers of the furnace core tube 4 and the cooling device 5 and then delivered through the centering and turning chain pulleys 29 and 30 from the reservoir tank 19 by means of the feeding chain pulley 31.

Figure 9:
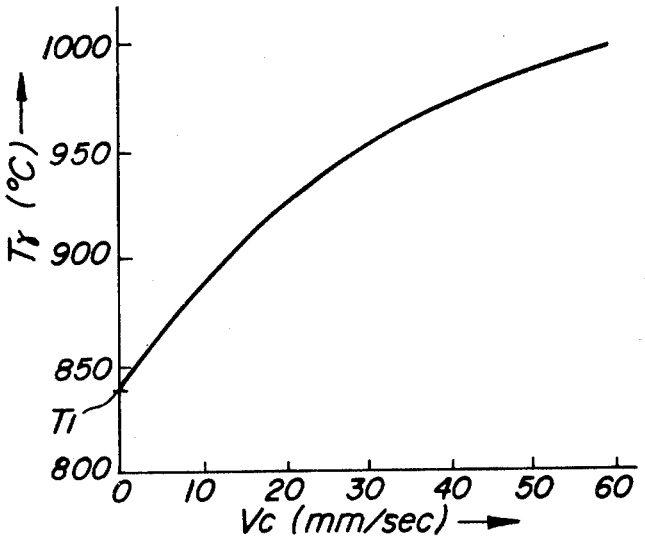
FIG. 9 is a diagram illustrating a typical example of the relation between austenitizing temperature $T_\gamma$ of the link chains and moving speeds of link chains during being heated for quenching according to the invention.

FIG. 9 illustrates a typical example of the relation between moving speeds Vc of link chains during being heated for quenching and austenitizing temperatures $T\gamma$ of the link chains. T1 in FIG. 9 is the Ac3 transformation point in the equilibrium condition.

Figure 10:
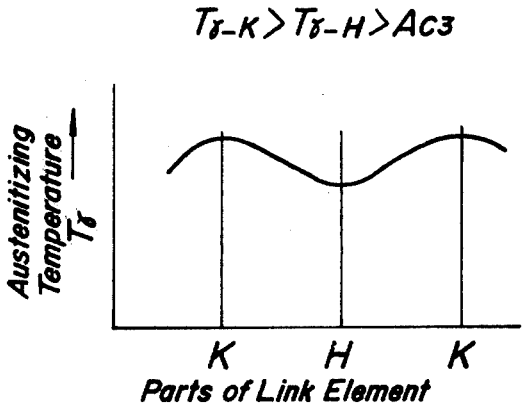
FIG. 10 is a diagram showing austenitizing temperatures of curved and parallel portions of link element for quenching according to the invention.

A link chain 27 to be heat treated is continuously introduced into the furnace core tube 14 of the high frequency induction furnace 4 of the quenching device 2 by means of the supply chain pulley 22 and heated by the high frequency induction heating coil 7 in such a manner that the parallel portions H of the link element 1 are heated at the austenitizing temperature $T\gamma$-H substantially the same as or higher than the Ac3 transformation point and the curved portions K of the link element are heated at the austenitizing temperature $T\gamma$-K higher than the $T\gamma$-H as shown in FIG. 10. Also, as shown in FIG. 10, it is important to note that the temperature transitions between curved and parallel portions are smooth and continuous and without abrupt changes. The link chain 27 thus heated to the different austenitizing temperatures is then quenched or hardened, immediately after being delivered from the furnace core tube 14, by means of the cooling liquid obliquely injected from the inner surface of the annular cooling device 5 into a forward direction of the link chain such that the cooling liquid does not spread in a direction opposite to the forward direction of the link chain.

Thus quenched link chain 27' passes about the centering and turning chain pulleys 23 and 24 within the reservoir tank 19 and fed toward the accumulating device by means of the feeding chain pulley 25. Thereafter the link chain 27' is driven about the adjusting and accumulating chain pulley 13 and a guide chain pulley 33 and is fed toward the feeding chain pulley 28 for the tempering device 3.

Figure 11:
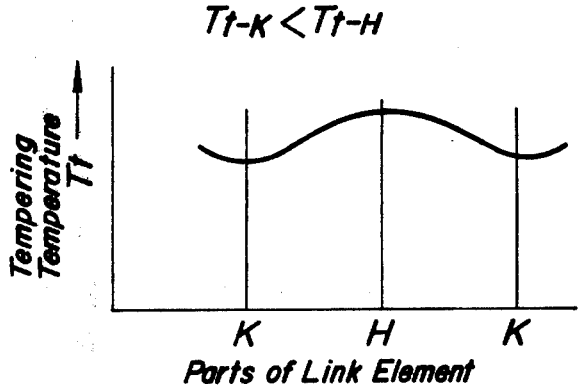
FIG. 11 is a diagram showing temperatures of curved and parallel portions of link element for tempering according to the invention.

The link chain 27' is continuously introduced into the furnace core tube 14 of the tempering device 3 by means of the supply chain pulley 28 and heated by the high frequency induction heating coil 7 in such a manner that the parallel portions H of the link element 1 is heated at the temperature Tt-H higher than that Tt-K of the curved portions K as shown in FIG. 11. Again, the temperature transitions between curved and parallel link portions are smooth and continuous. The link chain thus heated is then cooled and tempered, immediately after delivered from the furnace core tube 14, by means of the cooling liquid obliquely injected from the inner surface of the annular cooling device 5 into a forward direction of the link chain such that the cooling liquid does not spread in a direction opposite to the forward direction of the link chain in the same manner as in the quenching.

Thus quenched and tempered link chain 27" passes about the centering and turning chain pulleys 29 and 30 within the reservoir tank 19 and fed toward a desired place by means of the feeding chain pulley 31.

The cooling liquid injected from the annular cooling device 5 falls into the reservoir tank 19 and circulated by the pump 20 for repeated uses.

In this manner, according to the invention, link chains superior in all the properties are produced by heating each link element of the link chain at different temperatures. For this purpose, the temperatures at the curved and parallel portions of each link element of link chains are always measured for quenching and tempering to determine frequency and input for the high frequency induction heating, moving speed of the link chains, shapes of the link element and induction coil and the like.

The invention is further illustrated by the following example.

Link chains were quenched and tempered by passing them through the apparatus as shown in FIGS. 4–8. The link element of the link chains has a diameter of d=7.1 mm, a pitch of p=20.2 mm, and an inside width of b=8 mm and an outside width of B=22.2 mm and a chemical composition of C:0.25%, Si:0.11%, Mn:1.25%, P:0.012%, S:0.010%, B:0.004% and Fe:remainder.

(1) Quenching condition

A. High frequency induction heating

Frequency: 8 KHz

Power Input: 58 KW

B. Heating temperature

Temperature at curved portions of link element Tγ-K: 1,025° C.

Temperature at parallel portions of link element Tγ-H: 975° C.

C. Moving speed of link chains

Vc: 40 mm/sec

D. Hardness of quenched link

Curved portions HQ-K: HRC (Rockwell C scale) 49

Parallel portions HQ-H: HRC 46

(2) Tempering condition

A. High frequency induction heating

Frequency: 8 KHz

Input: 15 KW

B. Heating temperature

Temperature at curved portions of link element Tt-K: 470° C.

Temperature at parallel portions of link element Tt-H: 550° C.

C. Moving speed of link chains

Vc: 40 mm/sec

D. Hardness of tempered link

Curved portions HT-K: HRC (Rockwell C scale) 48

Parallel portions Ht-H: HRC 38

According to the above conditions, the link chains (specimens Nos. 1–6) were quenched and tempered by varying the quenching and tempering temperatures as shown in Table 1. The results of the tests on hardness and tensile strength are shown in Table 2.

Table 1

| Specimen No. | Quenching Temperature °C. Tγ-K | Tγ-H | Tempering Temperature °C. Tt-K | Tt-H | Remarks |
|---|---|---|---|---|---|
| 1 | 950 | 900 | 600 | 600 | Present invention |
| 2 | 950 | 900 | 550 | 600 | " |
| 3 | 1025 | 975 | 470 | 550 | " |
| 4 | 880 | 860 | 600 | 620 | " |
| 5 | 830 | 780 | 550 | 600 | (1) |
| 6 | 900 | 900 | 600 | 600 | (2) |

Note:
(1)Tγ-H < Ac3
(2)Prior art using an electric or gas furnace

Table 2

| Specimen No. | Hardness (Rockwell C scale) HRC Ht-K | Kt-H | Breaking stress N/mm² | Ultimate elongation % | Judgement |
|---|---|---|---|---|---|
| 1 | 38 | 35 | 960 | 19 | Good |
| 2 | 43 | 35 | 1010 | 25 | Good |
| 3 | 48 | 38 | 1150 | 22 | Good |
| 4 | 35 | 34 | 910 | 21 | Good |
| 5 | 31 | 29 | 750 | 23 | Bad |
| 6 | 32 | 34 | 730 | 11 | Bad |

Note:
(1)The breaking stress is obtained by dividing a breaking load by $2 \times \frac{\pi d^2}{4}$.
(2)According to the Standard of International Organization for Standardization (ISO), the breaking stress must be more than 800 N/mm².

In carrying out the invention, an inert gas such as Nitrogen or Argon or a carbohydrate gas as Propane may be introduced into the furnace core tube 14 to form a non-oxidizing atmosphere therein for a bright heat treatment without oxidation. A common carburizing gas may be supplied into the furnace core tube 14 to carburize the link chain and thereafter it is quenched.

Various advantages are obtained by the method and apparatus for heat treatment of a link chain by cooling it after continuous heating by high frequency induction heating according to the invention. The link chain is so heated that the austenitizing temperature Tγ-K at the curved portions K of link elements is higher than that Tγ-H at the parallel portions, so that even if the curved portions K are cooled somewhat insufficient in comparison with the parallel portions H, the curved portions can be brought into complete austenite structures for good quenching thereby increasing the mechanical strength of the curved portions K whose quenched hardness HQ-K is higher than that HQ-H of the parallel portions thereby increasing the wear resistant property of the curved portions. In tempering the link chain, moreover, according to the invention, the link elements are so heated that the temperature Tt-H at the parallel portions H is higher than that Tt-K at the curved portions K and therefore the tempered hardness HT-K at the curved portions K is higher than that Ht-H at the parallel portions H thereby increasing the wear resistance of the curved portions K as well as the toughness of the parallel portions H and eliminating metallurgical defects at the welding portion 12 to prevent breaking at that portion, with the result that the entire tensile strength of the link chain is increased and the ultimate elongation is also increased to improve its shock resistance. The thermometers 6 provided at the outlets of the high frequency induction heating furnaces 4 of the quenching and tempering devices 2 and 3 detect the temperatures at the curved and parallel portions K and H of the link elements 1 for automatically and precisely heating these portions.

It is further understood by those skilled in the art that the foregoing description is preferred embodiment of the disclosed method and apparatus and that various changes and modifications may be made in the invention without departing from the spirit and scope thereof.

What is claimed is:

1. A method of heat treating link chains of iron or steel wherein the link chain is continuously subjected to a high frequency induction heating, each link element of the link chain being heated such that the temperature at the curved portions of the link element is higher than at the parallel portions thereof, and the link chain thus heated is cooled to quench it, characterized in that the conditions of the high frequency induction heating and the speed of movement of the link chain are selected so that the austenitizing temperature $T_{\gamma\text{-}K}$ at the curved portions, the austenitizing temperature $T_{\gamma\text{-}H}$ at the parallel portions of the link chain and the temperature $TAc_3$ of the $Ac_3$ transformation point satisfy the relationship $$T_{\gamma\text{-}K} > T_{\gamma\text{-}H} \geqq TAc_3,$$

and that during the heat treatment the temperature changes smoothly and continuously thereby to avoid a sudden temperature transition between the curved and parallel portions of the link element.

2. A method of heat treating link chains as set forth in claim 1, said method further comprising steps of heating said quenched link chain such that said parallel portions are heated at a temperature higher than that of the curved portions of said each link element, and such that these temperatures change smoothly and continuously between said curved and parallel portions without abrupt transitions, and cooling the thus heated link chain to temper it.

3. A method of heat treating link chains as set forth in claim 1, wherein the frequency and power input for the high frequency induction heating are selected to obtain the austenitizing temperature at said curved portions higher than that at the parallel portions for quenching.

4. A method of heat treating link chains as set forth in claim 2, wherein the frequency and power input for the high frequency induction heating are selected to obtain the austenitizing temperature of said curved portions higher than that at the parallel portions for quenching and the temperature at the parallel portions higher than that at the curved portions for tempering.

5. A method of heat treating link chains as set forth in claim 2, wherein the moving speed of the link chain is selected to obtain the temperature at the parallel portions higher than that at the curved portions for tempering.

6. A method of heat treating link chains as set forth in claim 1, wherein said austenitizing temperature at the curved portions of said link element is between 880° C. and 1,025° C. and said austenitizing temperature at the parallel portions of said link element is between 860° C. and 975° C.

7. A method of heat treating link chains as set forth in claim 2, wherein said austenitizing temperature at the curved portions of said link element is between 880° C. and 1,025° C. and said austenitizing temperature at the parallel portions of said link element is between 860° C. and 975° C. for quenching, and the temperature at the curved portions of said link element is between 470° C. and 600° C. and the temperature at the parallel portions of said link element is between 550° C. and 620° C. for tempering.

8. A method of heat treating link chains as set forth in claim 1, wherein in cooling the heated link chain for quenching, a cooling liquid is obliquely injected against the link chain into a forward direction of the link chain such that the cooling liquid does not spread in a direction opposite to the forward direction of the link chain.

9. A method of heat treating link chains as set forth in claim 2, wherein in cooling the heated link chain for quenching and tempering, a cooling liquid is obliquely injected against the link chain into a forward direction of the link chain such that the cooling liquid does not spread in a direction opposite to the forward direction of the link chain.

10. The method of claim 7, wherein:

the frequency is 8 KHz,
the chain speed is 40 mm/sec,
the power input for quenching is 58 KW,
$T_{\gamma\text{-}K}$ for quenching is 1,025° C.,
$T_{\gamma\text{-}H}$ for quenching is 975° C.,
the power input for tempering is 15 KW,
the heating temperature for tempering the curved portions is 470° C., and
the heating temperature for tempering the parallel portions is 550° C.

* * * * *